US005803194A

United States Patent [19]

Rowlett

[11] Patent Number: 5,803,194

[45] Date of Patent: Sep. 8, 1998

[54] WEAR PROTECTOR FOR A DRILLING TOOL

[75] Inventor: Don C. Rowlett, Bedford, Pa.

[73] Assignee: Kennametal Inc., Latrobe, Pa.

[21] Appl. No.: 751,383

[22] Filed: Nov. 19, 1996

[51] Int. Cl.[6] ..... E21B 17/10

[52] U.S. Cl. ..... 175/325.2; 175/325.4; 175/408

[58] Field of Search ..... 175/325.2, 325.4, 175/344, 406, 408, 325.7, 325.5; 166/241.6

[56] References Cited

U.S. PATENT DOCUMENTS

| | | | |
|---|---|---|---|
| 2,022,101 | 11/1935 | Wright | 255/61 |
| 2,210,824 | 8/1940 | Walker, Sr. | 255/73 |
| 2,562,346 | 7/1951 | Whittaker | 255/73 |
| 2,715,552 | 8/1955 | Lane | 308/4 |
| 3,181,632 | 5/1965 | Raynal | 175/329 |
| 3,825,081 | 7/1974 | McMahon | 175/73 |
| 3,833,077 | 9/1974 | Lavallee | 175/325 |
| 3,945,446 | 3/1976 | Ostertag et al. | 175/323 |
| 3,978,933 | 9/1976 | Olson et al. | 175/325 |
| 4,011,918 | 3/1977 | Jurgens | 175/325 |
| 4,106,823 | 8/1978 | Bassinger | 308/4 A |
| 4,231,437 | 11/1980 | Swersky et al. | 175/325 |
| 4,245,709 | 1/1981 | Manuel | 175/325 |
| 4,258,804 | 3/1981 | Richey et al. | 175/325 |
| 4,378,852 | 4/1983 | Garrett | 175/408 X |
| 4,403,668 | 9/1983 | Ramsey | 175/325.4 |
| 4,549,613 | 10/1985 | Case | 175/325 |
| 4,638,873 | 1/1987 | Welborn | 175/325.2 X |
| 5,058,689 | 10/1991 | Collinsworth | 175/325 |
| 5,069,584 | 12/1991 | Obermeier et al. | 175/408 X |
| 5,180,021 | 1/1993 | Champion et al. | 175/325.2 X |
| 5,234,063 | 8/1993 | Collinsworth | 175/408 X |

OTHER PUBLICATIONS

BASCO Enterprises Drawing, Wear Bar (Oct. 12, 1995).

BASCO Enterprises, Inc. Brochure for Sub Saver Sleeve (date unknown).

*Primary Examiner*—William P. Neuder

*Attorney, Agent, or Firm*—John J. Prizzi

[57] ABSTRACT

A wear assembly for attachment to a protective sleeve for a drill bit sub wherein the wear assembly includes an elongate wear bar which has an interior surface for attachment to the protective sleeve. The wear bar also has an exterior surface. The wear bar further contains a slot opening at the exterior surface. The slot contains at least one hard insert affixed therein by brazing.

20 Claims, 3 Drawing Sheets

WEAR PROTECTOR FOR A DRILLING TOOL

BACKGROUND

Drilling tools that are used to drill holes in the ground include a drill bit sub at the lower end of the drilling tool. The drill bit sub has a drill bit, with cutters, threadedly connected at the bottom thereof. The drill bit sub carries a protective sleeve with a wear assembly thereon that helps protect the drill bit sub from wear. The wear assembly comprises an elongate wear bar with a plurality of holes contained therein. There is secured in each hole a wear resistant insert such as, for example, a generally cylindrical tungsten carbide (or cemented tungsten carbide) button insert. U.S. Pat. No. 5,058,689, to Collinsworth, describes such a drilling tool. Such a drilling tool also has been sold by Basco Enterprises, Inc., of Stanton, Ky. 40380, USA.

The above-mentioned drilling tools have suffered some drawbacks, especially in tough high abrasion applications. More specifically, these drilling tools have experienced excessive wear or failure of the cemented tungsten carbide cylindrical button inserts. This is due, at least in some instances, to the erosion of the steel surrounding the button insert, i.e., steel wash, which occurs during the drilling operation.

The above-mentioned drilling tools also have suffered drawbacks that pertain to the manufacture of the wear assembly therefor. In particular, the wear assembly has comprised a bar with holes drilled therein. It typically has been time-consuming, as well as expensive, to drill holes in the wear bar. A generally cylindrical button insert has then been brazed or interference fit into each hole. There can sometimes be difficulties associated with the effectiveness (or integrity) of the braze joint between the button insert and the wall of the bore.

It would thus be desirable to provide an improved protective sleeve for a drilling tool and especially an improved wear assembly for the protective sleeve, which provides for an increase in wear life over the above-mentioned earlier drilling tools.

It would also be desirable to provide an improved protective sleeve for a drilling tool and especially an improved wear assembly for the protective sleeve, wherein the protective sleeve uses a wear assembly that presents a wear bar with at least one generally rectangular slot into which there are brazed a plurality of generally rectangular hard inserts. Such a wear assembly provides advantages over earlier structures in that it is easier to machine a slot in the wear bar than to drill a plurality of holes therein. In addition, it is easier to braze a plurality of rectangular inserts into the generally rectangular slot than to braze a button insert with a generally cylindrical base section into a generally cylindrical bore.

It would also be desirable to provide an improved protective sleeve for a drilling tool and especially an improved wear assembly for the protective sleeve, wherein the wear assembly could have a number of different orientations of the hard inserts so as to address various specific applications.

SUMMARY OF THE INVENTION

In one form thereof, the invention is a wear assembly for attachment to a protective sleeve for a drill bit sub wherein the wear assembly includes an elongate wear bar which has an interior surface for attachment to the protective sleeve. The wear bar also has an exterior surface. The wear bar further contains a slot opening at the exterior surface. The slot contains at least one hard insert affixed therein.

BRIEF DESCRIPTION OF THE DRAWINGS

The following is a brief description of the drawing figures which form a part of this patent application.

DETAILED DESCRIPTION

Figure 1:
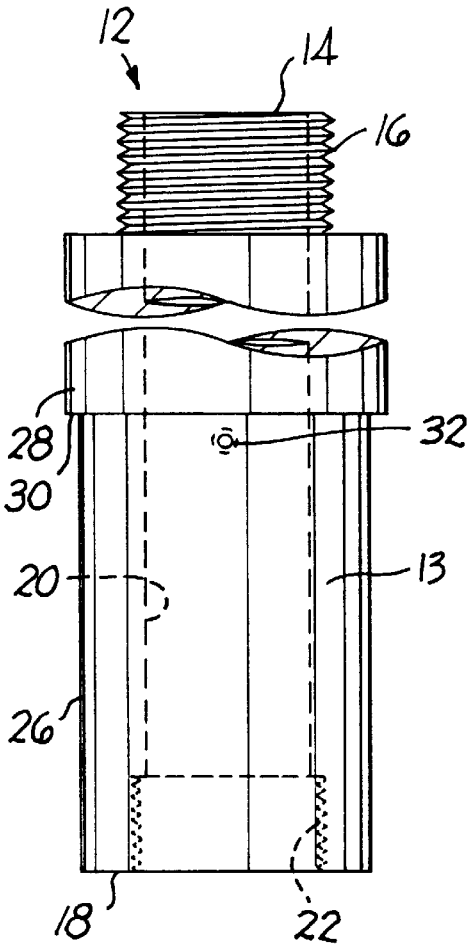
FIG. 1 is a side view of a drill bit sub.

Referring to the drawings, FIG. 1 depicts the drill bit sub generally designated as 12 of the drilling tool. Drill bit sub 12 has a drill bit sub body 13 with an upper end 14 which has a threaded portion 16 thereat. Drill bit sub 12 has a lower end 18. Drill bit sub 12 further contains a central longitudinal bore 20 with a threaded portion 22 at the lower end of the bore 20 so as to open at the lower end 18 of the drill bit sub 12.

Drill bit sub 12 is connected to the lowermost drill section of the drilling tool via the threaded portion 16 being received into the threaded receptacle of the drill section of the drilling tool. A description of a drill bit sub and the connection is found in U.S. Pat. No. 5,058,689, to Collinsworth, which is hereby incorporated by reference herein.

The body of the drill bit sub 12 further presents a reduced diameter portion 26 and an enlarged diameter portion 28. An axially downwardly facing shoulder 30 separates the reduced diameter portion 26 from the enlarged diameter portion 28. The body of the drill bit sub 12 also contains a threaded aperture 32 therein. Threaded aperture 32 is located below the axially downwardly facing shoulder 30 of the drill bit sub 12.

A lobed drill bit 40, which has a trio of lobes 42 with cemented carbide inserts 44 contained therein, is threadedly connected to the drill bit sub 12 via a threaded connection between the threaded upper portion 46 of the drill bit 40 and the threaded portion 22 of the central bore 20 in the drill bit sub 12.

There is an elongate generally cylindrical protective sleeve 50 which has an upper end 52, a lower end 54, and an exterior surface 55. The upper end 52 of the protective sleeve 50 has a recess 56 therein. A break out ring 60 is positioned between the shoulder 30 and the upper end 52 of the protective sleeve 50. Break out ring 60 includes a notch 62 and a recess 64. An Allen cap head screw 66 is threadedly received into the threaded hole 32 of the drill bit sub 12 whereby the head of the screw 66 engages the recesses 56 and 64 in the protective sleeve 50 and the break out ring 60, respectively, so as to help hold them in place.

Figure 2:
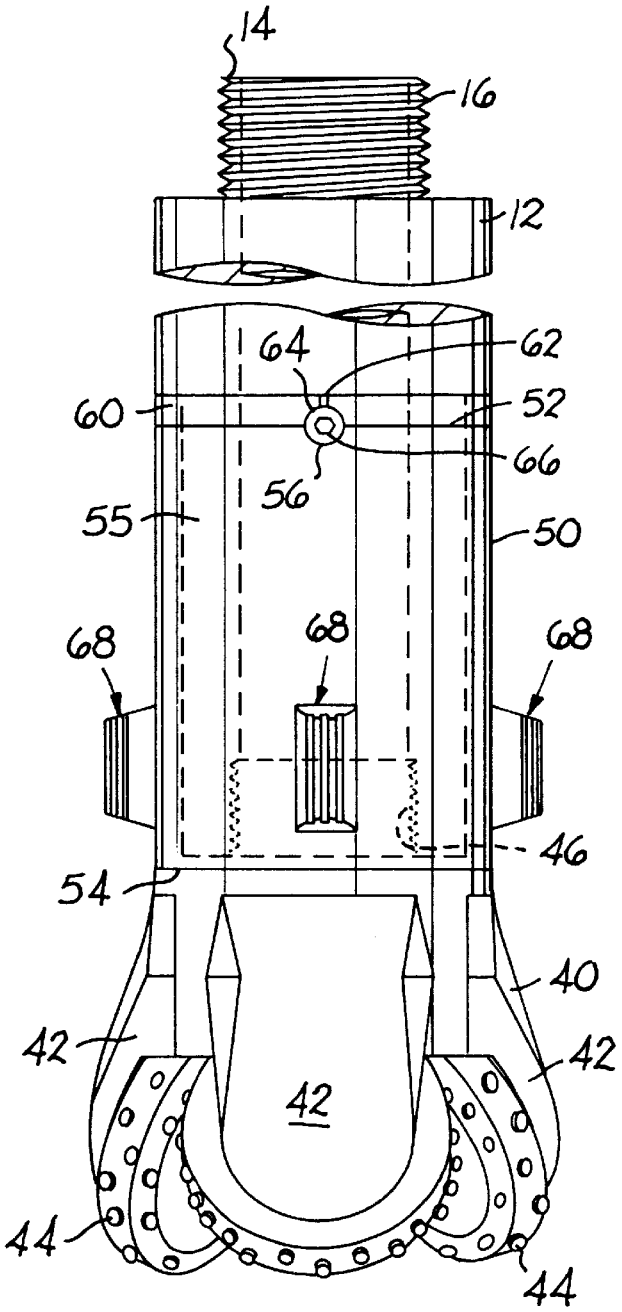
FIG. 2 is a side view of a specific embodiment of the drill bit sub of FIG. 1 with a drill bit attached thereto using a protective sleeve having a wear assembly.

Protective sleeve 50 further includes a plurality of wear assemblies 68. In the first specific embodiment depicted in FIG. 2, there are three wear assemblies 68 equi-spaced about the circumferential exterior surface 55 of the protective sleeve 50. While the specific embodiment depicts three wear assemblies, the applicant contemplates that other numbers of wear assemblies would be satisfactory for use.

Each wear assembly 68 includes an elongate wear bar 70 with a generally planar interior surface 72, an arcuate exterior surface 74, and opposite generally planar end surfaces 76 and 78. The wear bar 70 attaches at the interior surface 72 thereof to the exterior surface 55 of the protective sleeve 50 by welding, mechanical fastening, or the like. The exterior surface 74 of the wear bar 70 faces away from the protective sleeve 50.

Wear bar 70 contains an elongate side slot 80 of a generally rectangular cross-section which extends along the entire length of the wear bar 70. Side slot 80 presents a bottom surface 82, an outer side surface 84, and an inner side surface 86. Side slot 80 opens at the exterior surface 74 of the wear bar 70.

Wear bar 70 also contains an elongate central slot 88 of a generally rectangular cross-section which extends along the entire length of the wear bar 70. Central slot 88 presents a bottom surface 90, and opposite side surfaces 92 and 94. Central slot 88 opens at the exterior surface 74 of the wear bar 70.

Wear bar 70 contains a side slot 96 of a generally rectangular cross-section which extends along the entire length of the wear bar 70. Side slot 96 presents a bottom surface 98, an inner side surface 100, and an outer side surface 102. Side slot 96 opens at the exterior surface 74 of the wear bar 70.

Figure 3:
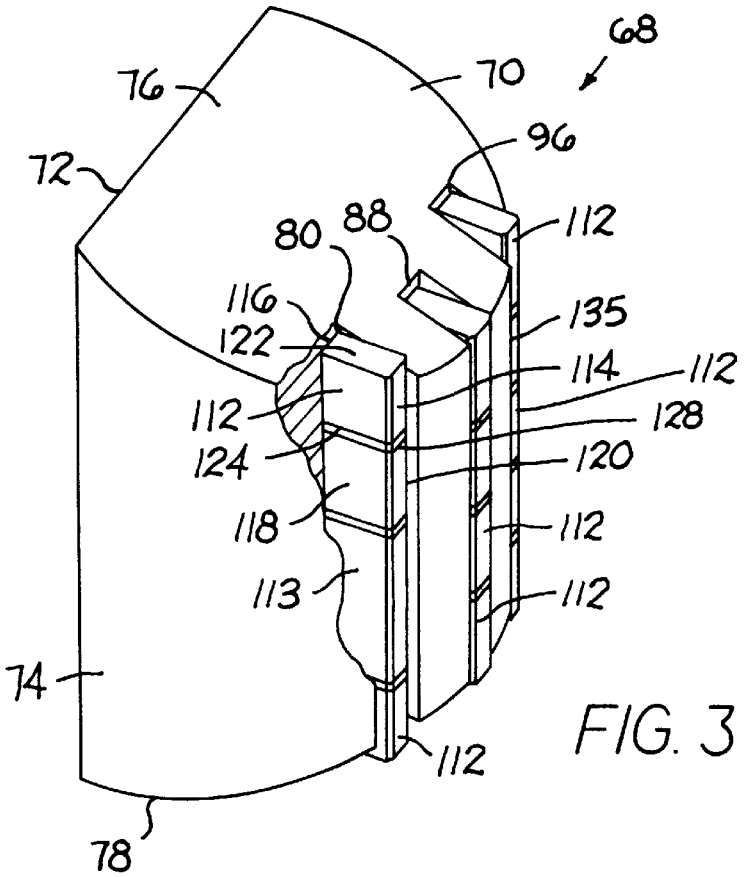
FIG. 3 is an isometric view of the steel wear bar assembly of the protective sleeve of FIG. 2 with a portion of the bar cut away to expose the hard inserts.
Figure 4:
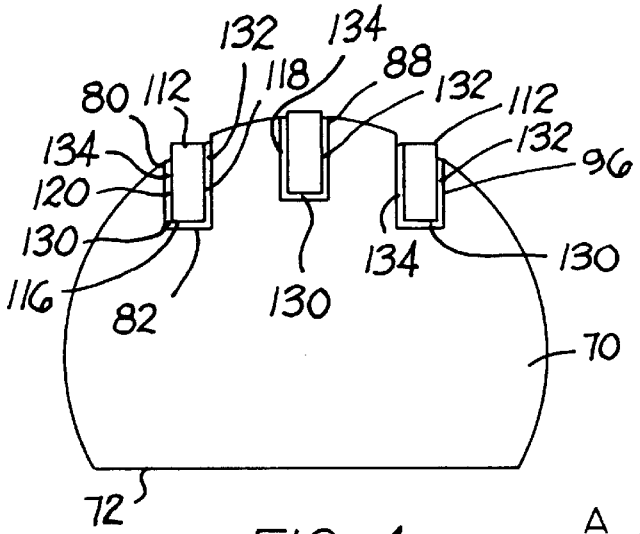
FIG. 4 is an end view of the steel wear bar assembly of FIG. 3 with the hard inserts brazed in the slots.
Figure 5:
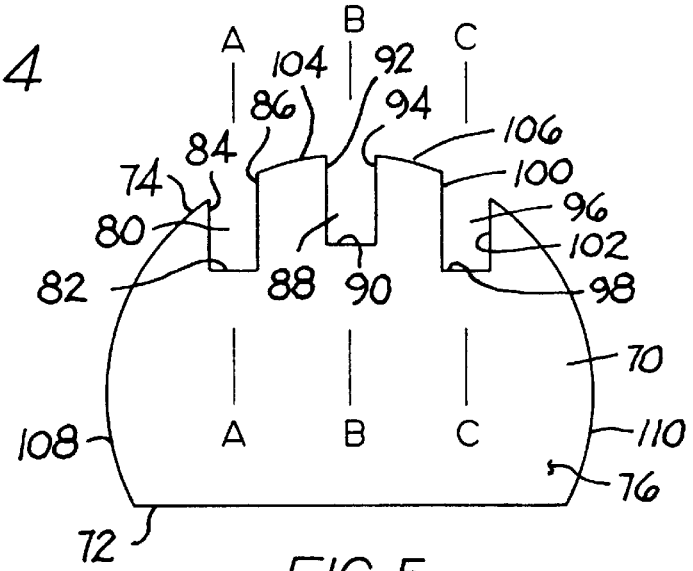
FIG. 5 is an end view of the steel wear bar of the wear assembly of FIG. 3 wherein the hard inserts are not in the slots and the outwardly projecting axes of each slot are generally parallel to one another.
Figure 6:
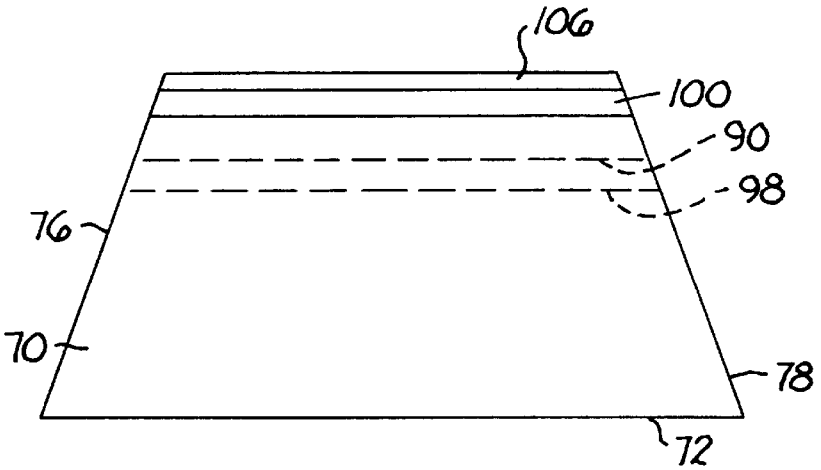
FIG. 6 is a side view of the steel wear bar of the wear assembly of FIG. 3.

Side slot 80 has an outwardly projecting axis A—A. Central slot 88 has an outwardly projecting axis B—B. Side slot 96 has an outwardly projecting axis C—C. As illustrated in FIGS. 3 and 4, these axes (A—A, B—B, C—C) have an orientation such that they are generally parallel to one another.

There is an arcuate land 104 between slot 80 and slot 88. There is an arcuate land 106 between slot 88 and slot 96. There is an arcuate side surface 108 between slot 80 and the bottom surface 72 of the wear bar 70. There is an arcuate side surface 110 between slot 96 and the bottom surface 72 of the wear bar 70.

A plurality of generally rectangular hard inserts 112 are affixed, such as, for example, by brazing, within the side slots 80 and 96 and central slot 88. Each hard insert 112 presents an exterior end 114, an interior end 116, opposite side surface 118, 120, a top surface 122, and a bottom surface 124. There is a braze joint between the surfaces of the hard inserts 112 that are adjacent to the proximate surfaces of the slot and the proximate surfaces of the adjacent hard insert or hard inserts. More specifically, there is a braze joint 128 between adjacent top and bottom surfaces (122, 124) of adjacent hard inserts 112. There is a braze joint 130 between the interior end 116 and the bottom surface (82, 90, 98) of each slot (80, 88, 96), respectively. There is a braze joint 132, 134 between the side surfaces (118, 120), respectively, and the corresponding adjacent side surface of the slot (80, 88, 96).

While the hard inserts 112 in central slot 88 are essentially identical, it should be appreciated that each slot may not contain identical hard inserts. For example, side slot 80 contains three hard inserts 112 of one dimension and another hard insert 113 of a larger (or different) dimension in that hard insert 113 has a greater length than hard inserts 112. Furthermore, the slots may contain one or more steel (or other material softer than the hard insert) spacer inserts when the drilling conditions are soft so as to conserve the amount of hard material (e.g., cemented tungsten carbide) necessary to adequately drill. In this regard, side slot 96 contains four hard inserts 112 as well as a steel spacer insert 135. It should also be appreciated that the number of hard inserts in the slots may vary depending upon the specific drilling application. It should also be appreciated that while the arrangement of the hard inserts (and possibly the spacer inserts) in each slot is typically the same, applicant contemplates that the slots may carry different arrangements of the hard inserts and spacer inserts, if any.

The preferred composition of the hard insert is a cemented tungsten carbide having about 11.3 weight percent cobalt with the balance being tungsten carbide having a grain size of between 1 and 9 micrometers ($\mu$m). The preferred composition of the braze alloy is a manganese bronze alloy sold by Cerro Metals under the designation W-17 and having a composition of 68.75 weight percent copper, the combination of tin, manganese, iron and nickel having a minimum content of 1.26 weight percent, and the remainder being zinc. While the above compositions are preferred, it should be appreciated that other compositions of cemented carbide and braze alloys may be suitable for use.

Figure 7:
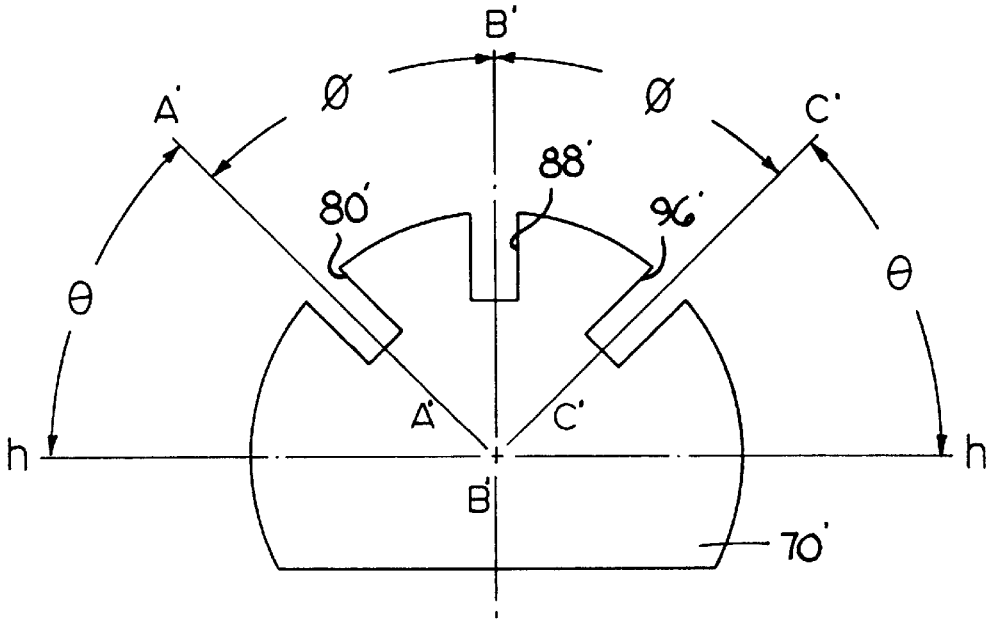
FIG. 7 is an end view of a second specific embodiment of the steel wear bar wherein the outwardly projecting axes of the side slots are disposed at an angle of about 45 degrees with respect to the outwardly projecting axis of the central slot.

Referring to FIG. 7, there is illustrated a second specific embodiment of the wear bar 70' of the wear assembly. Wear bar 70' includes a side slot 80' which has an outwardly projecting axis A'—A', a central slot 88' which has an outwardly projecting axis B'—B', and a side slot 96' which has an outwardly projecting axis C'—C'. The basic structure of the slots (80', 88', 96') is the same as that of the slots (80, 88, 96) in the first specific embodiment so that the description of the first specific embodiment will suffice for the description of the second specific embodiment in this respect.

The outwardly projecting axis B'—B' of the central slot 88' is disposed at an angle of about 90 degrees with respect to horizontal (h—h). This is in contrast to the outwardly projecting axis A'—A' of side slot 80' which is disposed at an angle $\theta$ with respect to horizontal (h—h). The outwardly projecting axis A'—A' of side slot 80' is also disposed at an angle $\phi$ with respect to the outwardly projecting axis B'—B' of the central slot 88'. The outwardly projecting axis C'—C' of side slot 96' is disposed at an angle $\theta$ with respect to horizontal (h—h). The outwardly projecting axis C'—C' of side slot 96' is also disposed at an angle $\phi$ with respect to the outwardly projecting axis B'—B' of the central slot 88'. Applicant has found that a drilling tool using a drill bit sub with a protective sleeve using the second specific embodiment of the wear assembly wherein the angle $\theta$ is equal to about 60 degrees and angle 100 is equal to about 30 degrees produces good drilling results in the drilling of blast holes.

It should be appreciated that the angles at which the slots are oriented may vary over a range. For example, the angle $\theta$ between the outwardly projecting axis C'—C' of the side slot 96' (as well as the outwardly projecting axis A'—A' of the side slot 80') and the horizontal may vary between 0 degrees and about 65 degrees. This means that the angle between the outwardly projecting axes of the opposite side slots (80', 96') may vary between about 50 degrees and about 180 degrees. The angle $\phi$ between the outwardly projecting axis B'—B' of the central slot 88" and the outwardly projecting axis (A'—A', C'—C') of either side slot (80', 96') may vary between about 25 degrees and about 90 degrees.

Another range for the angle θ between the outwardly projecting axis C'—C' of the side slot 96' (as well as the outwardly projecting axis A'—A' of the side slot 80') and the horizontal is between 45 degrees and about 65 degrees. The angle between the outwardly projecting axes of the opposite side slots (80', 96'), and the angle ϕ between the outwardly projecting axis B'—B' of the central slot 88" and the outwardly projecting axis (A'—A', C'—C') of either side slot (80', 96') may vary accordingly.

In operation, the protective sleeve with the wear assembly, and in particular the hard inserts, function in a sacrificial manner so as to prevent (or reduce) wear on the drill bit sub. Because the wear assembly uses hard inserts as described above, the life of the protective sleeve (and the drill bit sub) is enhanced.

The patents and other documents identified herein are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A wear assembly for attachment to a protective sleeve for a drill bit sub, the wear assembly comprising:

an elongate wear bar having an interior surface for attachment to the protective sleeve, the wear bar having an exterior surface;

the wear bar containing an elongate slot opening at the exterior surface; and p1 the slot containing at least one hard insert affixed therein.

2. The wear assembly of claim 1 wherein the slot extends along the entire length of the wear bar.

3. The wear assembly of claim 1 wherein the slot further contains a spacer insert affixed therein.

4. The wear assembly of claim 1 wherein the wear bar contains a plurality of the slots, and each of the slots having an outwardly projecting axis.

5. The wear assembly of claim 4 wherein the outwardly projecting axes of the slots are generally parallel to one another.

6. The wear assembly of claim 1 wherein the hard insert is affixed by brazing.

7. A wear assembly for attachment to a protective sleeve for a drill bit sub, the wear assembly comprising:

an elongate wear bar having an interior surface for attachment to the protective sleeve, the wear bar having an exterior surface;

the wear bar containing a slot opening at the exterior surface;

the slot containing at least one hard insert affixed therein; and wherein a plurality of the hard inserts are affixed in the slot, and the hard inserts being of different compositions.

8. A wear assembly for attachment to a protective sleeve for a drill bit sub, the wear assembly comprising:

an elongate wear bar having an interior surface for attachment to the protective sleeve, the wear bar having an exterior surface;

the wear bar containing a slot opening at the exterior surface;

the slot containing at least one hard insert affixed therein; and wherein a plurality of the hard inserts are affixed in the slot, and the hard inserts being of different dimensions.

9. A wear assembly for attachment to a protective sleeve for a drill bit sub, the wear assembly comprising:

an elongate wear bar having an interior surface for attachment to the protective sleeve, the wear bar having an exterior surface;

the wear bar containing a slot opening at the exterior surface;

the slot containing at least one hard insert affixed therein;

wherein the wear bar contains a plurality of the slots, and each of the slots having an outwardly projecting axis; and wherein the slots are oriented so that the outwardly projecting axis of one of the slots is disposed at an angle to the outwardly projecting axis of at least another one of the slots wherein the angle ranges between about 25 degrees to about 180 degrees.

10. A wear assembly for attachment to a protective sleeve for a drill bit sub, the wear assembly comprising:

an elongate wear bar having an interior surface for attachment to the protective sleeve, the wear bar having an exterior surface;

the wear bar containing a slot opening at the exterior surface;

the slot containing at least one hard insert affixed therein;

wherein the exterior surface of the wear bar is generally arcuate in shape, and the wear bar contains a trio of the slots wherein each one of the slots has an outwardly projecting axis; and wherein a central one of the slots is oriented with respect to opposite side ones of the slots so that the outwardly projecting axis of the central slot is disposed at an angle of between about 25 degrees and about 90 degrees with respect to the outwardly projecting axis of each one of the side slots.

11. The wear assembly of claim 10 wherein the angle of disposition is about 45 degrees.

12. The wear assembly of claim 10 wherein a central one of the slots is equi-spaced apart from each one of the side slots.

13. The wear assembly of claim 10 wherein the slots are oriented so that the outwardly projecting axes thereof are generally parallel to one another.

14. A sacrificial wear assembly for protecting a member, the wear assembly comprising:

an elongate wear bar having an interior surface for attachment to the member and an arcuate exterior surface facing away from the member, the wear bar containing a plurality of elongate slots therein wherein the slots are open at the exterior surface and extend along the entire length of the wear bar, and each one of the slots having an outwardly projecting axis; and each one of the slots having at least one hard insert affixed therein.

15. The wear assembly of claim 14 wherein the slots are oriented so that the axes thereof are generally parallel to one another.

16. The wear assembly of claim 15 wherein each one of the slots contains a plurality of the hard inserts.

17. A sacrificial wear assembly for protecting a member, the wear assembly comprising:

an elongate wear bar having an interior surface for attachment to the member and an arcuate exterior surface facing away from the member, the wear bar containing a plurality of elongate slots therein wherein the slots are open at the exterior surface and extend along the entire length of the wear bar, and each one of the slots having an outwardly projecting axis; and each one of the slots having at least one hard insert affixed therein; and wherein the slots are oriented so that the outwardly projecting axis of one of the slots is disposed at an angle to the outwardly projecting axis of at least another one of the slots.

18. The wear assembly of claim 17 wherein the angle of disposition ranges between about 25 degrees to about 180 degrees.

19. A drill bit sub comprising:

a drill bit sub body;

a sleeve being carried on the drill bit sub body, the sleeve having an exterior surface; and a wear assembly being attached to the protective sleeve, the wear assembly including an elongate wear bar having an interior surface for attachment to the protective sleeve, the wear bar having an exterior surface, the wear bar containing an elongate slot opening at the exterior surface, and the slot containing at least one hard insert affixed therein.

20. A The drill bit sub of claim 19 wherein the sleeve is generally cylindrical, and a plurality of the wear assemblies being attached to the exterior surface of the protective sleeve, and the plurality of the wear assemblies being equi-spaced about the exterior surface of the protective sleeve; and the wear bar containing a plurality of the slots, and a plurality of hard inserts being affixed in each one of the slots.

* * * * *